US005860850A

United States Patent [19]

Larimer et al.

[11] Patent Number: 5,860,850

[45] Date of Patent: Jan. 19, 1999

[54] METHOD AND KIT FOR PREPARING POLISHED AMBER

[76] Inventors: Roy E. Larimer; Jason G. Larimer, both of 14 Hanes Ct., Carmel, N.Y. 10512

[21] Appl. No.: 449,335

[22] Filed: May 24, 1995

[51] Int. Cl.[6] ..... B24B 1/00

[52] U.S. Cl. ..... 451/41; 29/896.41; 29/896.43; 264/DIG. 55; 451/57; 451/59; 451/559

[58] Field of Search ..... 29/896.4, 896.41, 29/896.411, 896.412, 896.43; 264/DIG. 55; 451/28, 41, 55, 57, 59, 559

[56] References Cited

U.S. PATENT DOCUMENTS

| | | | |
|---|---|---|---|
| 2,309,016 | 1/1943 | Ryan . | |
| 3,636,947 | 1/1972 | Balamuth . | |
| 3,841,031 | 10/1974 | Walsh . | |
| 3,891,409 | 6/1975 | Keith, Jr. . | |
| 3,955,942 | 5/1976 | Cordon et al. | 51/295 |
| 4,377,057 | 3/1983 | Pincha . | |
| 4,809,417 | 3/1989 | Normann, Jr. | 29/896.41 |
| 4,955,162 | 9/1990 | Jackson . | |
| 5,124,143 | 6/1992 | Muhlemann et al. | 51/308 X |
| 5,233,793 | 8/1993 | Dandurand et al. | 51/181 R |
| 5,503,592 | 4/1996 | Neumann | 451/57 X |
| 5,531,023 | 7/1996 | Armstrong | 29/896.41 |
| 5,589,160 | 12/1996 | Rice | 51/308 X |

OTHER PUBLICATIONS

Richard T. Liddicoat, Jr., Handbook Of Gem Identification, p. 271, 1948.

Karl Guckert, The Cutting And Polishing Of Amber, pp. 1–4, 1971.

Denise Hamilton, The Times Shopper: Yucatan's Surprising Stories of Amber Jewelry . . . , Los Angeles Times, p. 2, 1992.

*Primary Examiner*—Timothy V. Eley

*Attorney, Agent, or Firm*—Fish & Richardson P.C.

[57] ABSTRACT

A method and kit which allows unskilled persons to prepare polished amber in a supervised or unsupervised environment. The method includes steps employing inexpensive materials and polishing compounds. The preferred polishing compounds comprise ingredients that are generally recognized as safe. The kit according to this invention contains components that will enable an unskilled person or child to polish amber using the method of this invention in supervised or unsupervised environments.

18 Claims, No Drawings

METHOD AND KIT FOR PREPARING POLISHED AMBER

FIELD OF THE INVENTION

The present invention relates to the field of polishing gemstones. A method useful for enabling unskilled persons to polish amber using non-toxic and generally recognized as safe (GRAS) materials are provided. A kit containing components necessary for application of the method in supervised and unsupervised settings in the classroom and home environments are also encompassed in the invention.

BACKGROUND OF THE INVENTION

Amber is a composition of polymerized tree sap of prehistoric origin. It is of particular interest to natural scientists, hobbyists and craftspersons, because a variety of organic matter, including prehistoric insects, plant and animal materials, are often found embedded in amber. The inclusions may be studied for scientific merit or mere curiosity. Amber having inclusions has also found wide application in jewelry making.

Polishing amber by methods known in the gem polishing art involves the application of machine-driven abrasives and the use of toxic polishing compounds. Commonly, lapping machines, faceting machines and cabochon machines are used for the initial rough polishing. Thereafter, a variety of buffing machines are employed to produce the final finish. Polishing compounds are employed to provide a smooth surface.

The abrasives commonly used in conjunction with machine polishing are diamond abrasives embedded in wheels. Once the amber is roughly polished, polishing compounds are applied with buffing machines. Polishing compounds commonly used employ cerium oxide or aluminum oxide.

The amber polishing methods known in the art have certain disadvantages which make them impracticable and unsafe for use by children and other unskilled persons. The machinery and abrasives used in the art are expensive. Thus a casually interested person, a child or a schoolteacher is typically precluded from the use of such machines and abrasives. A major disadvantage of known methods is the toxicity of the polishing compounds. Therefore, the known methods are unsuitable for use by unskilled persons and children.

It is, therefore, an object of the present invention to provide a method and kit which overcome the aforementioned disadvantages by allowing unskilled persons to polish amber in supervised or unsupervised settings.

It is a further object of this invention to provide a method whereby an unskilled person can polish amber by hand using inexpensive abrasives and non-toxic compounds.

Another object of this invention is to provide a method in which the compound, or compounds, used for polishing amber are generally recognized as safe (GRAS) in the event that they are ingested.

Still another object of this invention is to provide a kit containing all of the components necessary to enable an unskilled person or child to perform the method of the invention in supervised or unsupervised settings in the classroom or home environment.

SUMMARY OF THE INVENTION

The method according to this invention comprises polishing amber by hand using successively finer grades of a water resistant abrasive sheet, such as wet/dry sandpaper or the like, and thereafter hand-polishing the amber to a smooth finish having a transparent surface using polishing compounds that are generally recognized as safe. A kit produced according to this invention contains components that will enable an unskilled person or child to polish amber using the method of this invention in supervised or unsupervised environments.

The method according to the present invention comprises the steps of wetting a first grade of a water resistant abrasive sheet, hand-polishing the amber with the abrasive, wetting a finer grade of abrasive sheet and further polishing the amber, optionally polishing the amber with one or more finer grades of wetted abrasive sheets, and finishing the amber by hand-polishing its surfaces with one or more non-toxic polishing compounds in the form of pastes, gels and/or liquids.

A kit according to this invention comprises a piece of unpolished amber, instructions and materials which are used to carry out the method of this invention. A kit according to this invention can further comprise jewelry supplies useful in creating a piece of jewelry containing the amber, or for mounting the amber for display.

DETAILED DESCRIPTION OF THE INVENTION

The method and kit of the present invention are useful for hand polishing amber to a smooth finish using common household abrasives, and then employing polishing compound(s) which contain ingredients that are GRAS (generally recognized as safe). After polishing the amber, the inclusions in the amber can be viewed for scientific study, mere curiosity, or the amber can be incorporated into a decorative piece of jewelry.

The method of this invention includes steps in which the rough amber is hand-polished with a water resistant abrasive sheet. Many such abrasives are known in the art. Examples of such abrasives include wet/dry sandpaper, non-woven abrasive webs and the like. It is preferred that the abrasive be non-toxic and inexpensive so that the method can be practiced by children.

In the steps employing the abrasive sheet, the amber and the abrasive sheet are wetted before polishing. It has been found that when the amber and the abrasive sheet are dry, the sheet is prone to clogging with ground amber. Moreover, the surface of the amber is more easily polished in a smoother and more uniform manner when both the surface and the abrasive are wetted. Therefore, it is preferred that the abrasive sheet be water resistant. The most preferred abrasive sheets are waterproof.

The amber and abrasive sheet are easily kept wetted during polishing by rinsing in water. If the amber and abrasive sheet are sufficiently wetted, the ground amber forms as a paste during polishing. There should be sufficient water present to keep the paste liquid. If the paste becomes thick during polishing, one can simply apply more water to the amber, the sheet, or both, before continuing.

In this phase of the method at least one step is employed. The number of steps employed are determined by the amount of polishing one desires to accomplish in each step. As will be recognized, coarse abrasives will polish faster and produce rougher surfaces than finer abrasives. For example, one can polish the surface of the amber in a first step with a relatively coarse grade of an abrasive sheet (e.g. 150–250 grit) to produce an abraded surface. In a subsequent step, a second abrasive, of a fine to ultra-fine grade (e.g. 500–1000 grit), can be used to produce a more polished surface.

As many steps as desired can be used in this phase of the method by use of successively finer abrasive sheets to produce successively more finely polished surfaces. By selection of the degree of difference in the abrasives, the rate of polishing in each step and the number of steps required to produce a surface of the desired level of smoothness are controlled.

It is preferred that a relatively coarse grade of abrasive sheet be used in the initial polishing step. A coarse grade helps to break up any "skin" that may be present on the surface of the amber. A coarse grade also allows the amber to be shaped, if desired. It is preferred that the final step in this phase of the method produce a finish comparable to the finish obtained using an abrasive of at least 500 grit.

Preferred embodiments of the method of this invention include the steps of polishing the amber by hand with water resistant, or waterproof sandpaper. More preferably, the method employs steps using successively finer grades of the sandpaper. In a more preferred embodiment, a first step using a sandpaper with a grit of 200 to 400 and a second step using a sandpaper having a finer grit, e.g. 500 to 1000, are employed. In the most preferred embodiment three or more steps are employed using successively finer abrasive sheets. A most preferred embodiment is the method includes three steps using, successively, 220, 400 and 600 grit sandpaper. However, in this phase of the method the number of steps employed and levels of grit to be used can be varied to control the amount and rate of polishing which occurs.

The method according to this invention includes at least one step in which the amber is polished to a high finish with nontoxic polishing compounds. Compounds comprising ingredients which are generally recognized as safe (GRAS), in the event of ingestion by humans, are preferred. An example of a GRAS compound, as the term is used herein, is toothpaste. Other polishing compounds, of similar safety, are also useful and can be employed in the method. In this step(s) of the method, a GRAS compound is applied to the polished amber resulting from the previous steps and the amber is hand-polished to produce a highly polished, transparent finish on the surface of the amber.

To determine whether a GRAS polishing compound is suitable for use in the method, the alternate polishing compound is substituted for a GRAS polishing compound known to perform well in the method. If the tested compound polishes the amber at a rate above 33% of the rate a GRAS compound known to perform well, i.e., the amber is polished with no more than three times the effort required for the preferred polishing compounds, then the tested compound is considered to be suitable for use in the method.

It has been discovered that commonly available toothpastes are well suited for polishing amber to a highly transparent surface finish. The use of toothpaste is a great advantage over the polishing compounds known in the art because known polishing compounds contain toxic ingredients such as cerium oxide, making such known compounds unsuitable for use by unskilled persons and children without close supervision. By using toothpaste as the polishing compound, little or no supervision is required when unskilled persons or children practice the method. Moreover, toothpaste is a common household item readily available for use in practicing the invention.

Paste type toothpastes are preferred over gel type toothpastes. It has been found that gel type toothpastes do not have as good a polishing effect as paste type toothpastes. Gel type toothpastes can become sticky during polishing and can leave a sticky residue on the amber. If a sticky residue forms, polishing becomes more difficult. However, not all gel type toothpastes may be unsuitable for use in practicing the method. To determine if any GRAS polishing compound is satisfactory, it is tested as described above.

The most preferred toothpaste used in the method to date is the Colgate® brand sold in the United States, although most other paste type toothpastes, both brand name and generic, also perform well. As noted above, other potential GRAS polishing compounds can be tested for use in the method to determine whether it is satisfactory.

The method of this invention optionally includes one or more additional steps using other polishing agents. Thus, an additional step in which the amber is polished using a furniture polish, furniture wax, car polish, car wax or other polishing agents can be employed. Polishing agents comprising Teflon®, or tetrafluorethylene (TFE) fluorocarbon polymers, can also be used and are preferred if a slippery surface is desired.

When employing the optional step using an additional polishing agent, silicone-containing compounds should not be used. It has been found that the application of polishing agents comprising silicone can cause the surface of the amber to take on a dull or cloudy finish.

The use of an additional polishing agent can provide several advantages. Additional polishing agents can impart a high lustre or shine to the surface of the amber to enhance the appearance of the finished product. They can also protect the amber from oxidation and discoloration which can occur over time. As in the other steps, GRAS compounds are preferred but are not required in these optional additional steps. If non-GRAS compounds are employed, supervision may be required depending on the ability and age of the person employing the method.

The method of this invention optionally includes fashioning the polished amber into a piece of jewelry or for display. The method optionally includes shaping the amber during the initial polishing step using a coarse abrasive sheet. In such a step, the coarse abrasive sheet can be employed to remove large amounts of amber from the starting piece of rough amber to achieve a desired shape.

For example, during the step employing the coarsest abrasive sheet, a portion of the amber can be shaped to fit a jewelry cap. Thereafter, the amber is polished according to the method described above and then attached to the cap. An epoxy glue or an instant glue, including cyanoacrylic glue, can be used to attach the cap. Alternatively, the amber can be shaped as desired for display alone or in an alternative mounting device.

A kit according to the invention enables an unskilled person, including a child, to employ the method of this invention in supervised or unsupervised settings in the school or home. A kit comprises a piece of rough amber, at least one grade of an abrasive sheet and instructions for performing the method according to this invention. The instructions can include guidance on selecting a readily available GRAS polishing compound. A kit can also comprise one or more GRAS polishing compounds, one or more additional polishing agents, or a combination thereof.

A kit can also include jewelry supplies and instructions on making a piece of jewelry. Jewelry supplies can be selected from glue, jewelry caps, lanyards, necklaces, earring studs or wires, bracelets and the like. The instructions can include directions for shaping the amber during polishing, e.g., for making jewelry or for display, alone or in a mounting device.

As will be recognized, rough amber is translucent. Before applying the method to polish the rough amber, inclusions in the amber may be visually located by holding the amber up to a bright light. Inclusions may be deep within the amber or close to the surface. Inclusions located near the surface should be identified so that, if desired, they are not destroyed during the polishing. Locating the inclusions also allows the amber to be shaped while applying the method of polishing, without destroying inclusions.

The following examples are included to describe particular embodiments of this invention. The examples are not intended to restrict the invention, which is not limited by the embodiments exemplified. Other embodiments of the invention will be apparent to those skilled in the art from the foregoing description and are within the scope of this invention.

EXAMPLE I

This example describes an embodiment of the method of this invention comprising three steps employing successively finer grades of a water resistant abrasive sheet, and a fourth step employing a paste type toothpaste. The abrasive sheet used in this example is a waterproof sandpaper known as TUFFBAK DURITE (No. T421, Norton Co., Troy, N.Y.).

After visually locating the inclusions in the amber the surface of the amber was hand-polished by wet-sanding the surface with a piece of 220 grit sandpaper. During this, and subsequent steps employing the abrasive sheet, the amber and the abrasive sheet were kept wet at all times. Sanding was continued until the surface of the amber was abraded.

In the second step, the amber surface was further polished by hand using a wetted 400 grit sandpaper. The sandpaper and the surface were kept wet during this step. This step was continued until the surface of the amber was substantially devoid of all the scratches left by the 220 grit sandpaper. A small stick wrapped with the sandpaper was used to polish in hard to reach areas on the surface of the amber.

In the third step, the surface of the amber was further polished by hand employing a 600 grit sandpaper. Again the amber and the sandpaper were kept wet at all times. This step was continued until the surface of the amber was substantially devoid of all of the scratches left by the 400 grit sandpaper.

In the fourth step, the surface of the amber was hand polished by applying a small amount of a paste type toothpaste (Colgate® toothpaste) to a damp cloth and polishing the surface until the surface became transparent when dry. After this step the amber was rinsed in water and dried.

EXAMPLE II

A piece of amber was polished using the method embodied in Example I. Thereafter, a further step was then employed in which the dried surface of the amber was polished by hand using a commonly available household furniture polish, Pledge®. The step was continued until the surface of the amber exhibited a high lustre.

EXAMPLE III

A piece of amber was polished as in Example I. Thereafter, a further step was employed in which the dried surface of the amber was polished by hand with a commonly available car wax, Rally®. This step was continued until the surface of the amber exhibited a high lustre.

EXAMPLE IV

A piece of amber was polished as in Example I except that during the first step the piece of amber was shaped during sanding. A portion of the amber was shaped to fit a jewelry cap. After the amber was suitably shaped, the cap was set aside until the amber was polished with the toothpaste. The amber was then glued to the jewelry cap with an epoxy glue, and made into a pendant.

What is claimed is:

1. A method for polishing the surface of a piece of amber by hand to produce a smooth and transparent surface finish comprising:

(a) rubbing the surface of the amber with a first wetted abrasive sheet having a grit from about 200 to about 400;

(b) rubbing the surface of the amber with a second wetted abrasive sheet having a grit from about 500 to 1000;

(c) rubbing the surface of the amber with a polishing compound, said polishing compound consisting of ingredients that are generally recognized as safe for human ingestion, to produce a highly polished surface on the amber; and (d) polishing the surface of the amber with a polishing agent selected from the group consisting of:
furniture polish, furniture wax, car polish and car wax.

2. The method according to claim 1 wherein said first and second abrasive sheets are sandpaper.

3. The method according to claim 1 wherein said abrasive sheets are sandpaper.

4. The method according to claim 1 wherein said polishing compound is a toothpaste.

5. The method according to claim 1 wherein step (a) includes shaping the amber.

6. The method according to claim 5 further comprising fashioning the amber into a piece of jewelry.

7. A method for polishing the surface of a piece of amber by hand to produce a smooth and transparent surface finish, the method comprising:

(a) rubbing the surface of the amber with a first wetted abrasive sheet having a grit from about 200 to about 300 to produce an abraded surface on the amber;

(b) hand-polishing said abraded surface with a second wetted abrasive sheet having a grit from about 300 to about 600 to produce a smoothly polished surface on the amber;

(c) hand-polishing said smoothly polished surface with a third wetted abrasive sheet having a grit from about 600 to 1000 to produce a finely polished surface on the amber;

(d) hand-polishing said finely polished surface with a polishing compound, said polishing compound consisting of ingredients that are generally recognized as safe for human ingestion, to produce a highly polished and transparent finish on the surface of the amber; and (e) polishing the surface of the amber with a polishing agent selected from the group consisting of:
furniture polish, funiture wax, car polish and car wax.

8. The method according to claim 7 wherein said abrasive sheets are sandpaper.

9. The method according to claim 7 wherein said polishing compound is a toothpaste.

10. The method according to claim 7 wherein step (a) includes shaping the amber.

11. The method according to claim 10 further comprising fashioning the amber into a piece of jewelry.

12. The method according to claim 7 wherein said abrasive sheets are waterproof.

13. A kit for polishing amber comprising:

a piece of rough amber, at least two grades of hand-held abrasive sheets, and instructions for rubbing the rough amber with said at least two grades of abrasive sheets and for polishing the surface of the amber with a polishing agent selected from the group consisting of furniture polish, furniture wax, car polish and car wax.

14. The kit according to claim 13 further comprising: a polishing compound for polishing said piece of rough amber, said polishing compound consisting of ingredients that are generally recognized as safe for human ingestion.

15. The kit according to claim 14 wherein said polishing compound is toothpaste.

16. The kit according to claim 13 wherein said abrasive sheets are sandpaper.

17. The kit according to claim 13 further comprising jewelry making supplies and instructions on shaping the amber and making a piece of jewelry.

18. The kit according to claim 13 wherein said abrasive sheets are waterproof.

* * * * *